US007916088B2

(12) United States Patent
Huang et al.

(10) Patent No.: US 7,916,088 B2
(45) Date of Patent: Mar. 29, 2011

(54) WIRELESS TRANSCEIVER

(75) Inventors: Cheng-Wen Huang, Taipei (TW); Shih-Jen Huang, Taipei (TW)

(73) Assignees: GIGA-BYTE Communications Inc., Taipei County (TW); GIGA-BYTE Technology Co., Ltd, Taipei Hsien (TW)

( * ) Notice: Subject to any disclaimer, the term of this patent is extended or adjusted under 35 U.S.C. 154(b) by 656 days.

(21) Appl. No.: 11/837,730

(22) Filed: Aug. 13, 2007

(65) Prior Publication Data

US 2009/0046021 A1 Feb. 19, 2009

(51) Int. Cl.
*H01Q 1/22* (2006.01)

(52) U.S. Cl. ..... 343/702; 343/906

(58) Field of Classification Search ..... 343/702, 343/750, 841, 906, 742, 788, 856, 867; 455/404.2
See application file for complete search history.

(56) References Cited

U.S. PATENT DOCUMENTS 5,717,767 A * 2/1998 Inanaga et al. ..... 381/309
6,907,234 B2 * 6/2005 Karr et al. ..... 455/193.1
7,072,698 B2 * 7/2006 Underbrink et al. ..... 455/575.5
2005/0040224 A1 * 2/2005 Brinton et al. ..... 235/376
2006/0166719 A1 * 7/2006 Arad et al. ..... 455/575.2
2006/0258289 A1 * 11/2006 Dua ..... 455/41.3
2007/0060221 A1 * 3/2007 Burgan et al. ..... 455/575.7
2007/0159402 A1 * 7/2007 Fossett ..... 343/702
2007/0293188 A1 * 12/2007 Houghton et al. ..... 455/404.2
2009/0098825 A1 * 4/2009 Huomo et al. ..... 455/41.1

* cited by examiner

*Primary Examiner* — Douglas W Owens
*Assistant Examiner* — Chuc D Tran
(74) *Attorney, Agent, or Firm* — J.C. Patents

(57) ABSTRACT

A wireless transceiver is provided. The wireless transceiver includes an antenna unit, a connection port and an integrated circuit. The antenna unit detects an electromagnetic signal in the space. The connection port provides a connective path to a transmission line. The integrated circuit is coupled to the antenna unit and the connection port. The integrated circuit receives the electromagnetic signal through the antenna unit. When the transmission line is coupled to the connection port, the integrated circuit enhances and restores the electromagnetic signal through an auxiliary electromagnetic signal received by the transmission line.

9 Claims, 3 Drawing Sheets

WIRELESS TRANSCEIVER

BACKGROUND OF THE INVENTION

1. Field of the Invention

The present invention relates to a wireless transceiver. More particularly, the present invention relates to a wireless transceiver using a transmission line to enhance its signal reception capacity.

2. Description of Related Art

With the development of technology, there is a rapid development in wireless communication techniques, and the functions of handheld communication devices increased accordingly. For example, a current cell phone can not only make just phone calls as a conventional cell phone did, but also make video phone calls. Moreover, a current cell phone has the functions of surfing on Internet, receiving/sending e-mails, using the MSN, and even receiving television (TV) signals for watching TV programs.

However, digital TV applies a novel transmission technique, by which the analogy signals sent out from the TV station are transmitted in a digital way. Comparing with the conventional analogy TV, the digital TV has the features of multi-channel, interaction, mobile reception and non-synchronization.

For implementation of mobile reception, electromagnetic signals are transmitted to the wireless transceiver by means of wireless transmission. Since the electromagnetic signal may has a fading phenomenon due to reflections of the ground surface and the objects, or due to the allocating position and the allocating angle of the antenna. Therefore, a current wireless transceiver usually receives the electromagnetic signals through two antennas to enhance its signal reception capacity. With improvement of life quality, miniaturization of the wireless transceiver is required. However, if two antennas are disposed in the limited hardware space of the wireless transceiver, miniaturization of the wireless transceiver cannot be achieved. Therefore, how to improve the signal reception capacity of a wireless transceiver based on miniaturization of the wireless transceiver is a key problem that manufacturers try to solve.

SUMMARY OF THE INVENTION

The present invention is direct to a wireless transceiver having an enhanced signal reception capacity without increasing hardware space of the wireless transceiver, so as to avoid the fading phenomenon occurred on a wireless transceiver due to environmental factors.

The present invention provides a wireless transceiver including an antenna unit, a connection port and an integrated circuit. The antenna unit detects an electromagnetic signal in the space. The connection port provides a connective path to a transmission line. The integrated circuit is coupled to the antenna unit and the connection port. The integrated circuit receives the electromagnetic signal through the antenna unit. When the transmission line is coupled to the connection port, the integrated circuit enhances and restores the electromagnetic signal through an auxiliary electromagnetic signal received by the transmission line.

In an embodiment of the present invention, the wireless transceiver further includes a housing, a screen and a control key. The housing is used for covering the integrated circuit, the antenna unit and partial surface of the connection port. The screen and the control key are disposed on the surface of the housing. The screen is used for displaying the information of the wireless transceiver. The control key is used for operating the wireless transceiver.

In another embodiment of the present invention, the wireless transceiver further includes a housing, a screen and a control key. The housing is used for covering the integrated circuit and the partial surface of the connection port. The antenna unit is disposed on the surface of the housing. The screen is used for displaying the information of the wireless transceiver. The control key is used for operating the wireless transceiver.

In still another embodiment of the present invention, the antenna unit includes an earphone and an earphone socket. The earphone socket is coupled to the integrated circuit and the earphone. The integrated circuit detects and receives the electromagnetic signal through metal lines inside the earphone. Moreover, in the present embodiment, the wireless transceiver further includes a housing, a screen and a control key, wherein the housing is used for covering the integrated circuit and the partial surface of the connection port and the earphone socket. The screen is used for displaying the information of the wireless transceiver. The control key is used for operating the wireless transceiver.

According to the present invention, an auxiliary electromagnetic signal is received through metal lines inside the transmission line. The electromagnetic signal received by the antenna unit is enhanced and restored through the auxiliary electromagnetic signal for avoiding the fading phenomenon occurred on a wireless transceiver due to environmental factors.

In order to make the aforementioned and other objects, features and advantages of the present invention comprehensible, a preferred embodiment accompanied with figures is described in detail below.

DESCRIPTION OF EMBODIMENTS

Before embodiments are described for disclosing the spirit of the present invention, first assuming the wireless transceiver mentioned in the following embodiments is a common wireless communication product such as cell phone, interphone, personal digital assistant (PDA) or portable TV etc. Therefore, the electromagnetic signal received by the wireless transceiver includes the TV signals bearing the standards of digital video broadcast-terrestrial and national television system committee, or the RF signals bearing the standards of global system for mobile communications, general packet radio services, wideband code division multiple access, personal handy-phone system, Bluetooth, global positioning system and wireless fidelity.

However, the present invention is no limited to the aforementioned wireless communication products. It should be understood by those having ordinary skill in the art, along with the development of technology, new wireless communication products are still within the scope of the present invention.

Figure 1A:
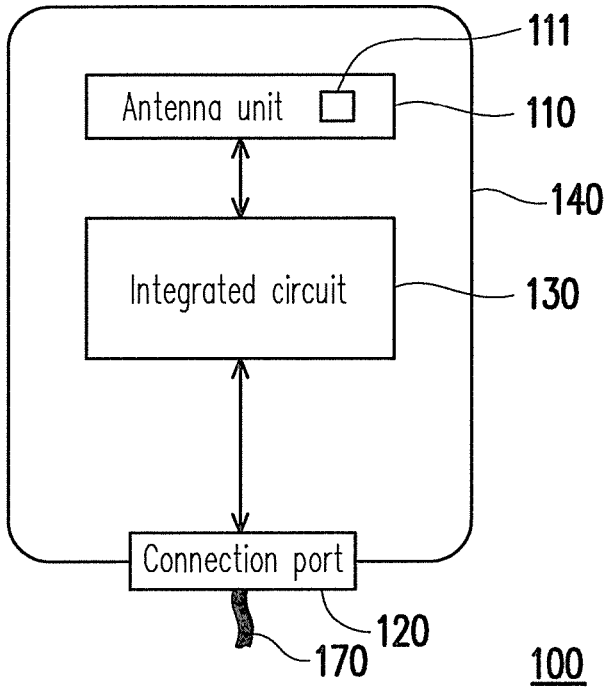
FIGS. 1A and 1B are respectively inner view and front view of a wireless transceiver 100 according to an embodiment of the present invention.

FIG. 1A is an inner view of a wireless transceiver according to an embodiment of the present invention. Referring to FIG. 1A, the wireless transceiver 100 includes an antenna unit 110, a connection port 120, an integrated circuit 130 and a housing 140. The antenna unit 110 and the connection port 120 are respectively coupled to the integrated circuit 130. The housing 140 is used for covering the integrated circuit 130, the antenna unit 110 and partial surface of the connection port 120.

Referring to FIG. 1A again, the antenna unit 110 detects the electromagnetic signal in the space. The connection port 120 provides a connective path to a transmission line 170 through its surface exposed on the housing 140. The integrated circuit 130 receives the electromagnetic signal through the antenna unit 110. When the transmission line 170 is coupled to the connection port 120, the integrated circuit 130 further receives an auxiliary electromagnetic signal in the space through metal lines inside the transmission line 170. Since the transmission line 170 and the antenna unit 110 are disposed at different positions in the wireless transceiver 100, the transmission line 170 and the antenna unit 110 may detect signals coming from different directions. Accordingly, the signal intensity of the auxiliary electromagnetic signal received by the transmission line 170 is different from that of the electromagnetic signal received by the antenna unit 110. Therefore, the integrated circuit 130 may enhance and restore the electromagnetic signal received by the antenna 110 through the auxiliary electromagnetic signal.

In other words, the transmission line 170 is used as another antenna unit of the wireless transceiver 100, which may detect a signal coming from another direction in the space. For example, if the electromagnetic signal received by the antenna 110 has a fading phenomenon due to environmental factors (e.g. usage of a mobile device with high-speed movement, or reflections of the ground surface and the objects), the wireless transceiver 100 may enhance and restore the electromagnetic signal received by the antenna 110 through an auxiliary electromagnetic signal received by the transmission line 170.

Figure 1B:
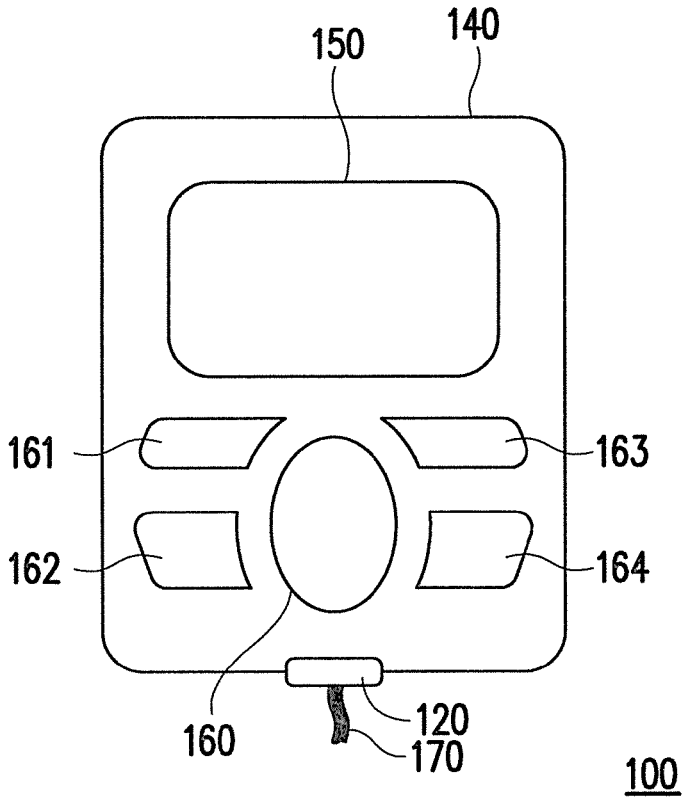

Moreover, FIG. 1B is a front view of the wireless transceiver 100. Referring to FIGS. 1A and 1B, the wireless transceiver 100 further includes a screen 150 and a control key, wherein the control key includes a jog dial 160 and buttons 161~164. The screen 150, the jog dial 160 and the buttons 161~164 are respectively coupled to the integrated circuit 130 and disposed on the surface of the housing 140. The screen is used for displaying the information of the wireless transceiver 100. The jog dial 160 and the buttons 161~164 are respectively used for operating the wireless transceiver 100.

It is noticeable that, the antenna unit 110 of the present embodiment includes an antenna 111, wherein the antenna 111 may be a meander line antenna, a loop antenna, an inverted L antenna or a planar inverted F antenna. Moreover, the numbers of the jog dial 160 and the buttons 161~164 disposed on the surface of the wireless transceiver 100 of the present invention are not fixed. In other words, those having ordinary knowledge in the art may determine the number of the jog dial and the buttons according to actual requirement.

Though a preferable example of the wireless transceiver 100 is described above, it should be understood by those having ordinary knowledge in the art that different manufacturer have different design of the wireless transceiver 100, therefore the application of the present invention is not limited to the preferable example described above. In other words, as long as the wireless transceiver 100 connects the transmission line 170 through the connection port 120, and enhances its signal reception capacity through an auxiliary electromagnetic signal received by the transmission line 170, it will be considered to be within the scope of the present invention.

Figure 2A:
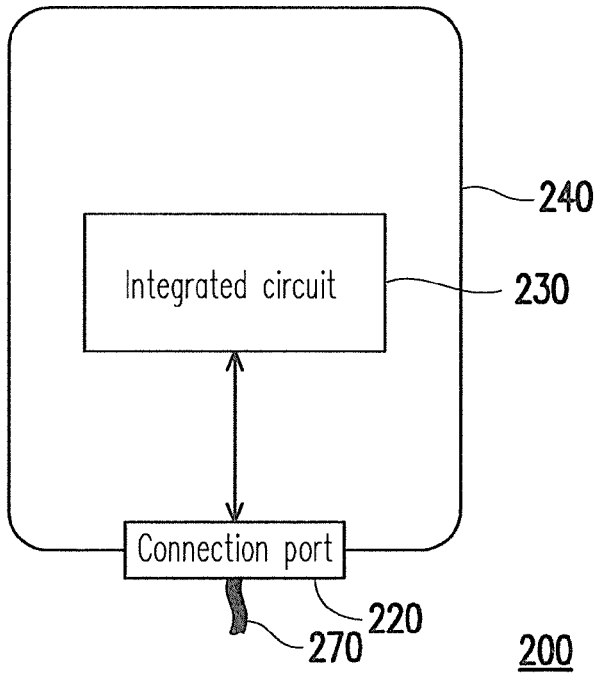
FIGS. 2A and 2B are respectively inner view and front view of a wireless transceiver 200 according to another embodiment of the present invention.
Figure 2B:
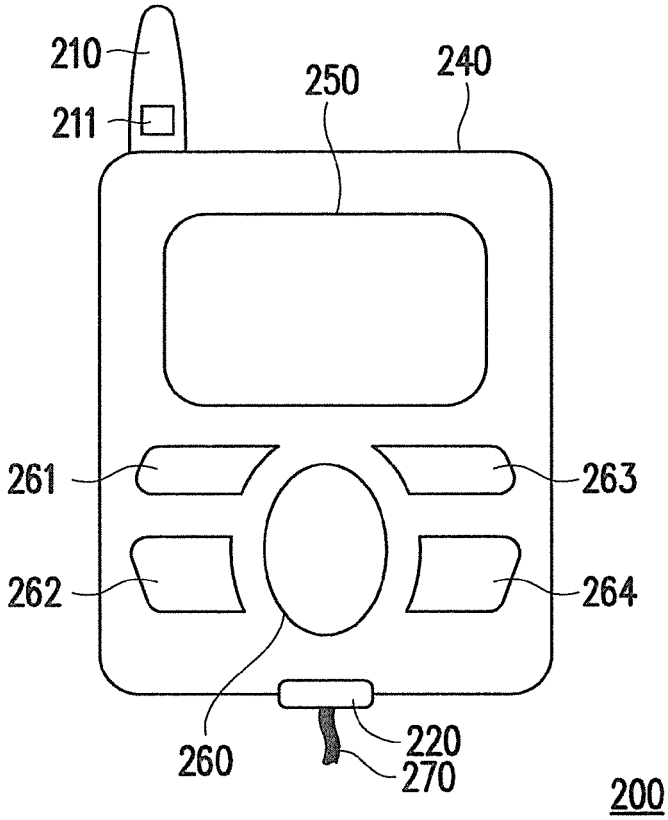

Here another example of wireless transceiver is provided for disclosing the spirit of the present invention. FIGS. 2A and 2B are respectively inner view and front view of a wireless transceiver 200 according to another embodiment of the present invention. Referring to FIGS. 2A and 2B, the wireless transceiver 200 includes an antenna unit 210, a connection port 220, an integrated circuit 230 and a housing 240. The connection port 220 is coupled to the integrated port 230. The antenna unit 210 is disposed on the surface of the housing 240 and coupled to the integrated circuit 230. The housing 240 is used for covering the integrated circuit 230 and partial surface of the connection port 220.

Moreover, the wireless transceiver 200 further includes a screen 250 and a control key, wherein the control key include a jog dial 260 and buttons 261~264. The screen 250, the jog dial 260 and the buttons 261~264 are respectively coupled to the integrated circuit 230 and are disposed on the surface of the housing 240.

Referring to FIGS. 2A and 2B again, this embodiment is similar to the aforementioned embodiment, by which the connection port 220 also provides a connective path to a transmission line 270, and when the transmission line 270 is coupled to the connection port 220, the transmission line 270 is used as another antenna unit of the wireless transceiver 200, such that the electromagnetic signal received by the antenna unit 210 can be enhanced and restored through an auxiliary electromagnetic signal received by the transmission line 270. The difference of these two embodiments is that the antenna unit 210 of the wireless transceiver 200 of the present embodiment is disposed on the surface of the housing 240, and the antenna unit 210 of the present embodiment includes an antenna 211, wherein the antenna 211 may be a helical antenna or a telescopic antenna. The other detailed descriptions of the present embodiment are similar to that of the aforementioned embodiment, and the repeated descriptions will be omitted hereby.

Figure 3A:
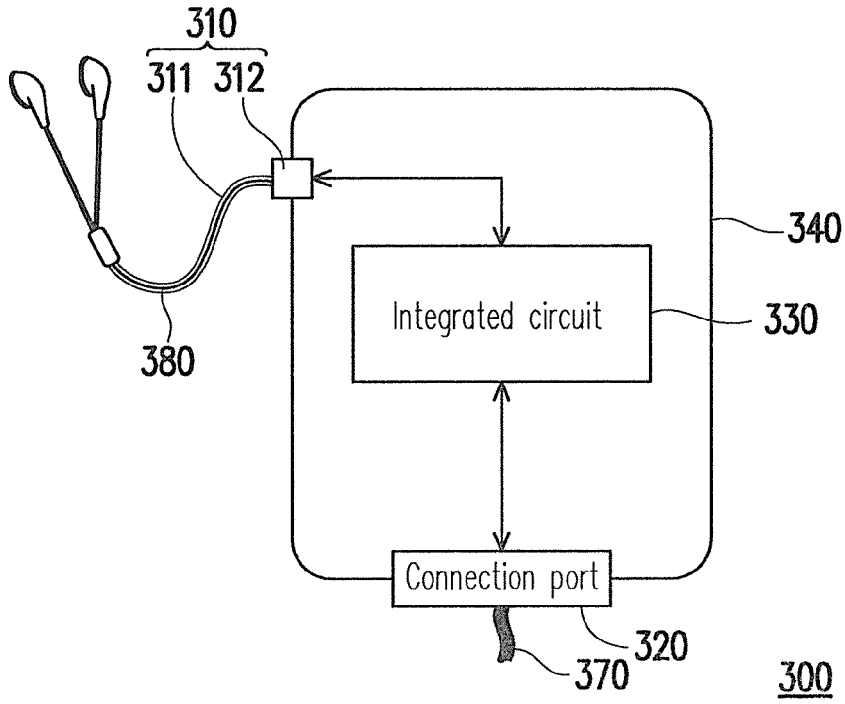
FIGS. 3A and 3B are respectively inner view and front view of a wireless transceiver 300 according to a further embodiment of the present invention.
Figure 3B:
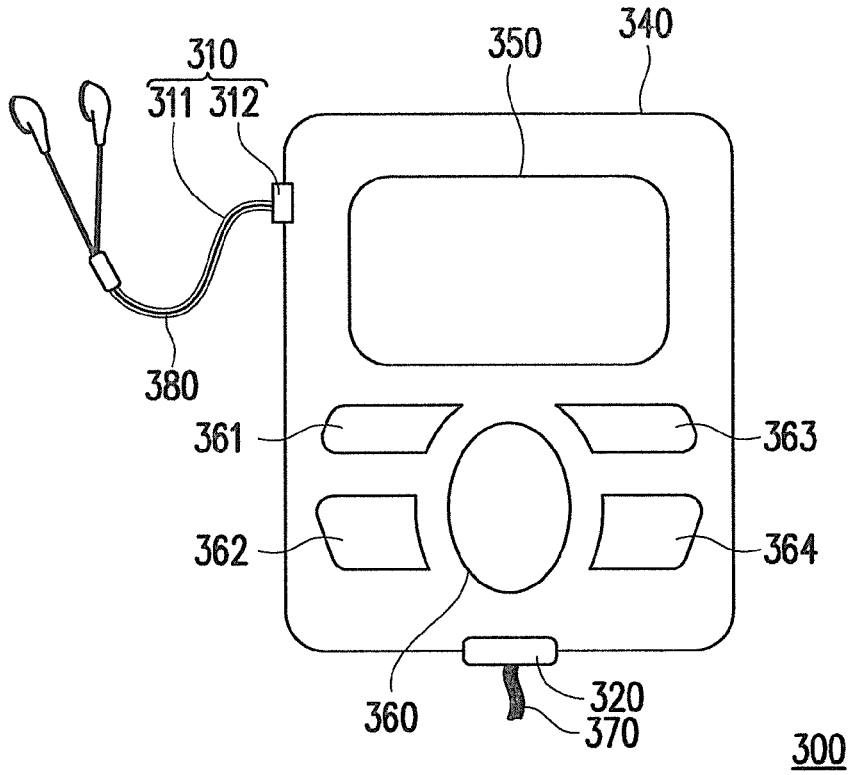

Here still another example of wireless transceiver is provided for disclosing the spirit of the present invention. FIGS. 3A and 3B are respectively inner view and front view of a wireless transceiver 300 according to a further embodiment of the present invention. Referring to FIGS. 3A and 3B, the wireless transceiver 300 includes an antenna unit 310, a connection port 320, an integrated circuit 330 and a housing 340. The antenna unit 310 further includes an earphone 311 and an earphone socket 312. The connection port 320 and the earphone socket 312 are respectively coupled to the integrated port 330. The earphone 311 is coupled to the earphone socket 312. The housing 340 is used for covering the integrated circuit 330 and partial surface of the connection port 320 and the earphone socket 312.

Moreover, the wireless transceiver 300 further includes a screen 350 and a control key, wherein the control key include a jog dial 360 and buttons 361~364. The screen 350, the jog dial 360 and the buttons 361~364 are respectively coupled to the integrated circuit 330 and are disposed on the surface of the housing 340.

Referring to FIGS. 3A and 3B again, this embodiment is similar to the aforementioned embodiment, by which the connection port 320 also provides a connective path to a transmission line 370, and when the transmission line 370 is coupled to the connection port 320, the transmission line 370 is used as another antenna unit of the wireless transceiver 300, such that the electromagnetic signal received by the antenna 310 can be enhanced and restored through an auxiliary electromagnetic signal received by the transmission line 370. The difference of these two embodiments is that the earphone 311 and the earphone socket 312 are used as the antenna unit 310 of the wireless transceiver 300. In other words, the integrated circuit 330 utilizes the metal lines 380 inside the earphone 310 to detect and receive the electromagnetic signal in the space. The other detailed descriptions of the present embodiment are similar to that of the aforementioned embodiments, and the repeated descriptions will be omitted hereby.

It is noticeable that the connection port of the wireless transceiver in the aforementioned each embodiment may be a universal serial bus or a charging slot. However, the connection port is not limited to these, as long as the transmission line coupled to the connection port uses metal lines as transmission media, it will be considered to be within the scope of the present invention.

In summary, according to the present invention, when a transmission line is coupled to the connection port of the wireless transceiver, the electromagnetic signal received by the antenna unit can be enhanced and restored through an auxiliary electromagnetic signal received by the transmission line. Therefore, the wireless transceiver according to the present invention may effectively increase its signal reception capacity for avoiding the fading phenomenon occurred on the wireless transceiver due to environmental factors. Moreover, since the transmission line is used as another antenna according to the present invention, comparing with the conventional techniques, the wireless transceiver of the present invention further has an advantage of miniaturization.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A wireless transceiver, comprising:

an antenna unit, for detecting an electromagnetic signal in a wireless environment;

a connection port, for providing a connective path to a transmission line; and an integrated circuit, coupled to the antenna unit and the connection port, receiving the electromagnetic signal through the antenna, wherein when the transmission line is coupled to the connection port, the integrated circuit enhances and restores the electromagnetic signal through an auxiliary electromagnetic signal received by the transmission line in the wireless environment;

a housing, for covering the integrated circuit and the partial surface of the connection port, wherein the antenna unit is disposed on the surface of the housing;

a screen, disposed on the surface of the housing and coupled to the integrated circuit, for displaying information of the wireless transceiver; and a control key, disposed on the surface of the housing and coupled to the integrated circuit, for operating the wireless transceiver.

2. The wireless transceiver as claimed in claim 1, wherein the control key comprises at least a button and/or at least a jog dial.

3. The wireless transceiver as claimed in claim 1, wherein the antenna unit comprises a helical antenna or a telescopic antenna.

4. The wireless transceiver as claimed in claim 1, wherein the electromagnetic signal comprises the TV signals bearing the standards of digital video broadcast-terrestrial and national television system committee.

5. The wireless transceiver as claimed in claim 1, wherein the electromagnetic signal comprises the RF signals bearing the standards of global system for mobile communications, General packet radio services, wideband code division multiple access, personal handy-phone system, Bluetooth, global positioning system, and wireless fidelity.

6. The wireless transceiver as claimed in claim 1, wherein the connection port comprises a universal serial bus or a charging slot.

7. The wireless transceiver as claimed in claim 1, wherein the signal intensity of the auxiliary electromagnetic signal is different from that of the electromagnetic signal.

8. The wireless transceiver as claimed in claim 1, wherein the antenna unit further comprises:

an earphone, for detecting the electromagnetic signal through metal lines inside the earphone; and an earphone socket, coupled to integrated circuit and the earphone, wherein the integrated circuit receives the electromagnetic signal through the earphone.

9. The wireless transceiver as claimed in claim 8, wherein the housing further covers the partial surface of the earphone socket.

* * * * *